US006404392B1

(12) United States Patent
Blom

(10) Patent No.: US 6,404,392 B1
(45) Date of Patent: Jun. 11, 2002

(54) ANTENNA DEVICE FOR DUAL FREQUENCY BANDS

(75) Inventor: Carl Gustaf Blom, Lysekil (SE)

(73) Assignee: Moteco AB, Ruda (SE)

( * ) Notice: Subject to any disclaimer, the term of this patent is extended or adjusted under 35 U.S.C. 154(b) by 0 days.

(21) Appl. No.: 09/570,433

(22) Filed: May 12, 2000

Related U.S. Application Data

(63) Continuation of application No. PCT/SE98/02032, filed on Nov. 11, 1998.

(30) Foreign Application Priority Data

Nov. 14, 1997 (SE) ..... 9704168

(51) Int. Cl.[7] ..... H01Q 1/24
(52) U.S. Cl. ..... 343/702; 343/895; 343/900
(58) Field of Search ..... 343/702, 900, 343/901, 903, 895, 715

(56) References Cited

U.S. PATENT DOCUMENTS

| | | | | |
|---|---|---|---|---|
| 4,730,195 A | | 3/1988 | Phillips et al. | 343/792 |
| 5,479,178 A | * | 12/1995 | Ha | 343/702 |
| 5,764,191 A | * | 6/1998 | Tsuda | 343/702 |
| 5,771,023 A | | 6/1998 | Engblom | 343/702 |
| 5,825,330 A | * | 10/1998 | Na et al. | 343/702 |
| 5,859,617 A | * | 1/1999 | Fujikawa | 343/702 |
| 5,969,684 A | * | 10/1999 | Oh et al. | 343/702 |
| 6,018,321 A | * | 1/2000 | Simmons et al. | 343/702 |
| 6,075,489 A | * | 6/2000 | Sullivan | 343/702 |
| 6,204,818 B1 | * | 3/2001 | Chang et al. | 343/702 |
| 6,239,768 B1 | * | 5/2001 | Oh et al. | 343/895 |
| 6,246,372 B1 | * | 6/2001 | Egawa et al. | 343/702 |

FOREIGN PATENT DOCUMENTS

| | | |
|---|---|---|
| EP | 0 790 666 A1 | 8/1997 |
| GB | 2 206 243 A | 12/1988 |
| WO | WO 95/12224 | 5/1995 |
| WO | WO 99/39403 | 8/1999 |

OTHER PUBLICATIONS

International Search Report for PCT/SE98/02032.
PCT International Preliminary Examination Report for PCT/SE98/02032.

* cited by examiner

*Primary Examiner*—Tan Ho
(74) *Attorney, Agent, or Firm*—Smith, Gambrell & Russell, LLP

(57) ABSTRACT

An antenna device for a radio communications apparatus operating in dual frequency bands and having one antenna element (18, 23) for each of the frequency bands. The antenna elements are included in a rod-shaped arrangement and are disposed in line with one another. The antenna element (18) which is intended for the higher frequency band is galvanically coupled to the circuits in the radio communications apparatus and is designed as a rod or bar antenna (18). The antenna element (23) for the lower frequency and is a helix, whose one end portion (24) surrounds an end portion of the rod or bar antenna (18). The antenna elements (18, 23) are capacitatively coupled to one another so that the helix constitutes a capacitative top load to the rod or bar antenna (18).

24 Claims, 4 Drawing Sheets

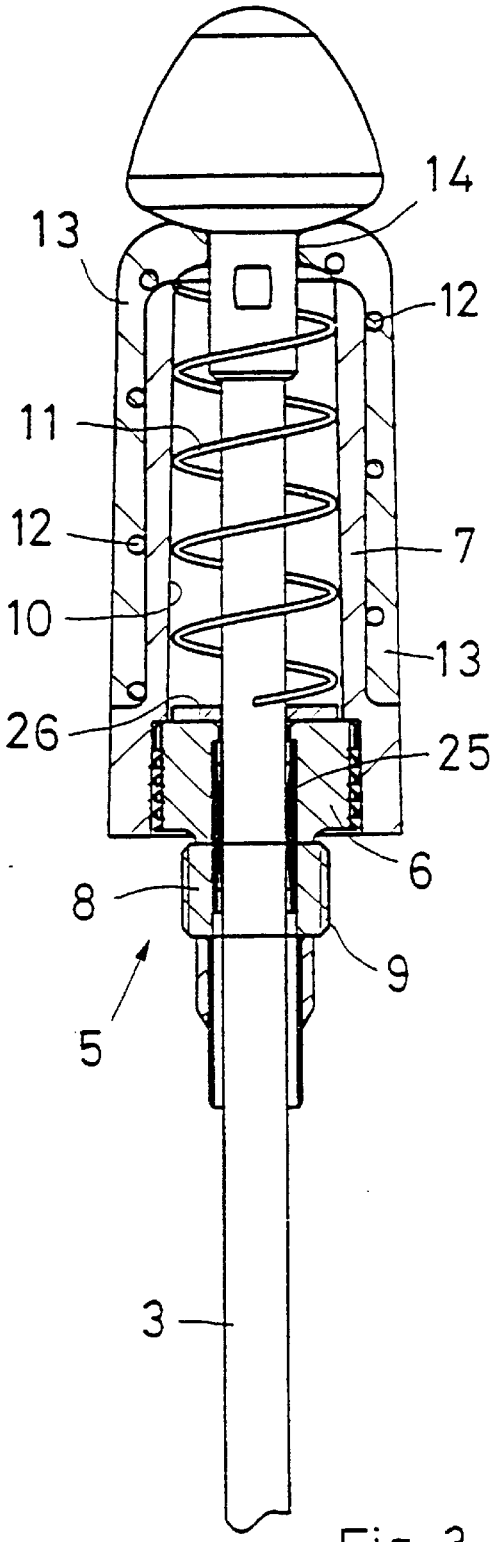
Fig 3
Fig 4
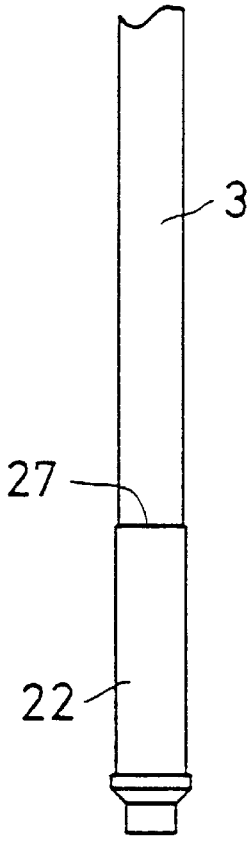
Fig 5
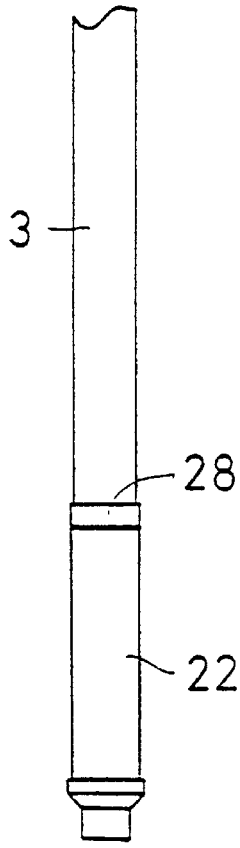

ANTENNA DEVICE FOR DUAL FREQUENCY BANDS

This application is a continuation of PCT/SE98/02032 having an International filing date of Nov. 11, 1998 and which is incorporated herein by reference in its entirety.

TECHNICAL FIELD

The present invention relates to an antenna device for a radio communications apparatus operating in dual frequency bands, and comprising one antenna element for each frequency band.

BACKGROUND ART

In radio communications apparatuses, in daily parlance known as mobile telephones, use is made of different antennae for different operational states in the apparatus. In the talk position of the apparatus, use is made of an antenna in which the most important requirements involve a high degree of efficiency.

Mobile telephones operate within different frequency bands, for example approx. 450 MHz in the NMT band, approx. 900 MHz in the GSM band and approx. 1800 MHz in the DCS band. There are also mobile telephones which are designed to be able to operate in more than one frequency band, and such constructions require antenna capacity in both frequency bands.

As regards the switching between stand-by position (or paging mode) and talk position, use is often made of mechanical switches which are based on the retraction or protraction of an antenna rod. To employ, in addition to such a switch, also a switch for switching between different frequency bands would appear to be clumsy and difficult to operate.

PROBLEM STRUCTURE

The present invention has for its object to design the antenna device intimated by way of introduction such that it obviates the requirement on the use of switches for switching between different frequency bands. The present invention further has for its object to design the subject matter of the invention such that this will have a high degree of efficiency in both frequency bands, and may be manufactured simply and economically and with the requisite mechanical strength.

BRIEF DESCRIPTION OF THE ACCOMPANYING DRAWINGS

The present invention will now be described in greater detail hereinbelow, with reference to the accompanying Drawings. In the accompanying Drawings:

FIG. 3 is a cross section through the upper end portion of the antenna device according to FIG. 2;

FIG. 4 shows a lower end portion of an antenna rod included in the antenna device according to FIGS. 1 and 2;

FIG. 5 shows a modified embodiment of the lower end of the antenna rod according to FIG. 2;

DESCRIPTION OF PREFERRED EMBODIMENT

The present invention will be described as included in an antenna device which, in addition to antenna elements for talk position, also includes antenna elements for stand-by position, so called paging mode. The antenna arrangement in which the device according to the present invention is included is, therefore, a complete dual band antenna switchable between stand-by position and talk position.

Figure 1:
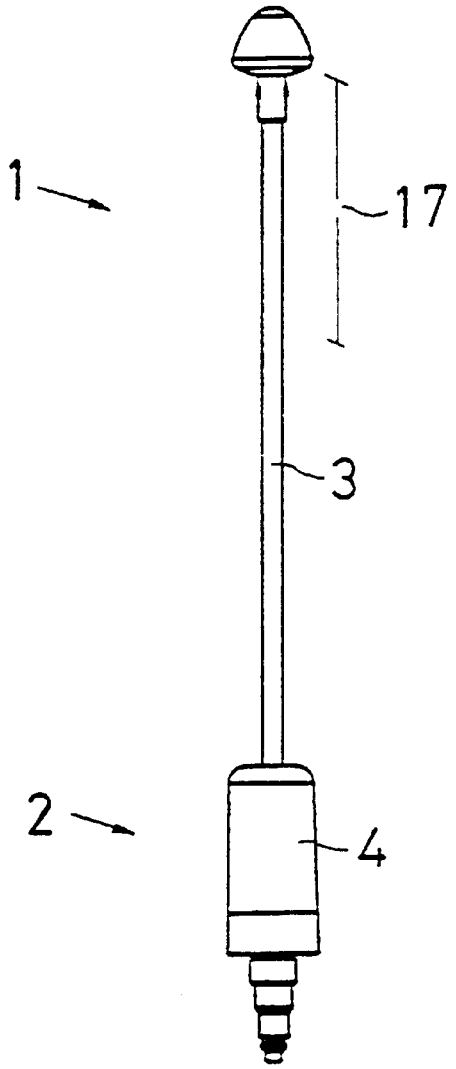
FIG. 1 shows, in the talk position, a complete, dual band antenna device in which the subject matter of the present invention is included.
Figure 2:
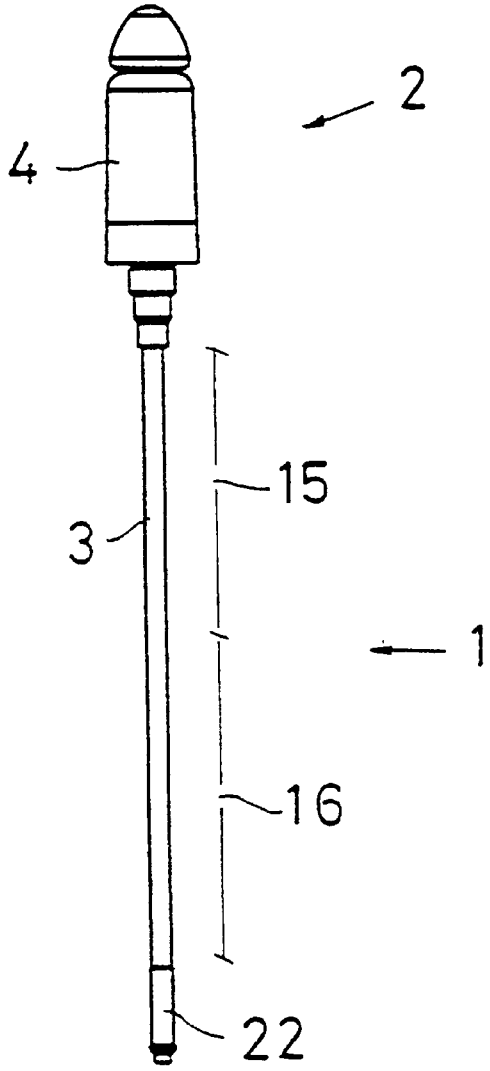
FIG. 2 shows the antenna device of FIG. 1 in the stand-by position, or paging mode.

From FIGS. 1 and 2 taken together, it will be apparent that the antenna device includes a first antenna unit 1 which is designed as a rod arrangement 3, and a second antenna unit 2 which is designed as a helix arrangement 4. The helix arrangement 4 is secured in the radio communications apparatus, in daily parlance the mobile telephone, which the antenna arrangement is intended to serve.

The first antenna unit 1 is of dual band design in order to be able to operate within both frequency bands for which the mobile telephone is rehearsed. Correspondingly, the second antenna unit 2 is also of dual band design for the same frequency bands as the first antenna unit. The first antenna unit is intended for the talk position of the mobile telephone, while the second antenna unit 2 is intended for the stand-by position, the paging mode, of the mobile telephone. Switching between the talk position and stand-by position is realised by displacement of the first antenna unit 1 in its longitudinal direction through the second antenna unit 2 between both of the states which are shown in FIGS. 1 and 2. It should be observed that, in the state for stand-by position (FIG. 2), it is only the second antenna unit 2 which is visible on the outside of the outer casing of the mobile telephone.

The antenna device includes means for electric switching between stand-by position and talk position, and the switching between these two positions is realised by the above-mentioned displacement movement of the first antenna unit 1.

The means for switching between stand-by position and talk position may include either an electric switching device or a device for bringing one of the antenna units to a resonance position which is located a safe distance outside the selected frequency bands when the relevant antenna unit is not to be employed.

The antenna device further includes means for switching the two antenna units 1 and 2 between the relevant frequency bands. Such means are designed in such a manner that no mechanical switching arrangement is included therein. Instead, the switching is realised between the frequency bands in that radiating antenna elements included in the antenna units are capacitatively or inductively engaged and disengaged, respectively.

In FIG. 1, it is intimated that the rod arrangement 3 has an upper portion 17 which is produced from electrically insulating and non-magnetic material. The longitudinal extent of the upper portion 17 is such that, when the antenna device is located in the position according to FIG. 2, the upper portion 17 is to fill out in the longitudinal direction at least the helix arrangement 4 and its lower mounting and connection parts and fittings. The reason for this is that, in the stand-by position, FIG. 2, where the helix arrangement 4 is located in operation, there cannot be any electrically conductive magnetic material interiorly in the helix arrangement 4 without seriously disrupting its function.

The rod arrangement 3 has further a third antenna element 15 intended for the lower frequency band and a fourth antenna element 16 intended for the higher frequency band.

Figure 6:
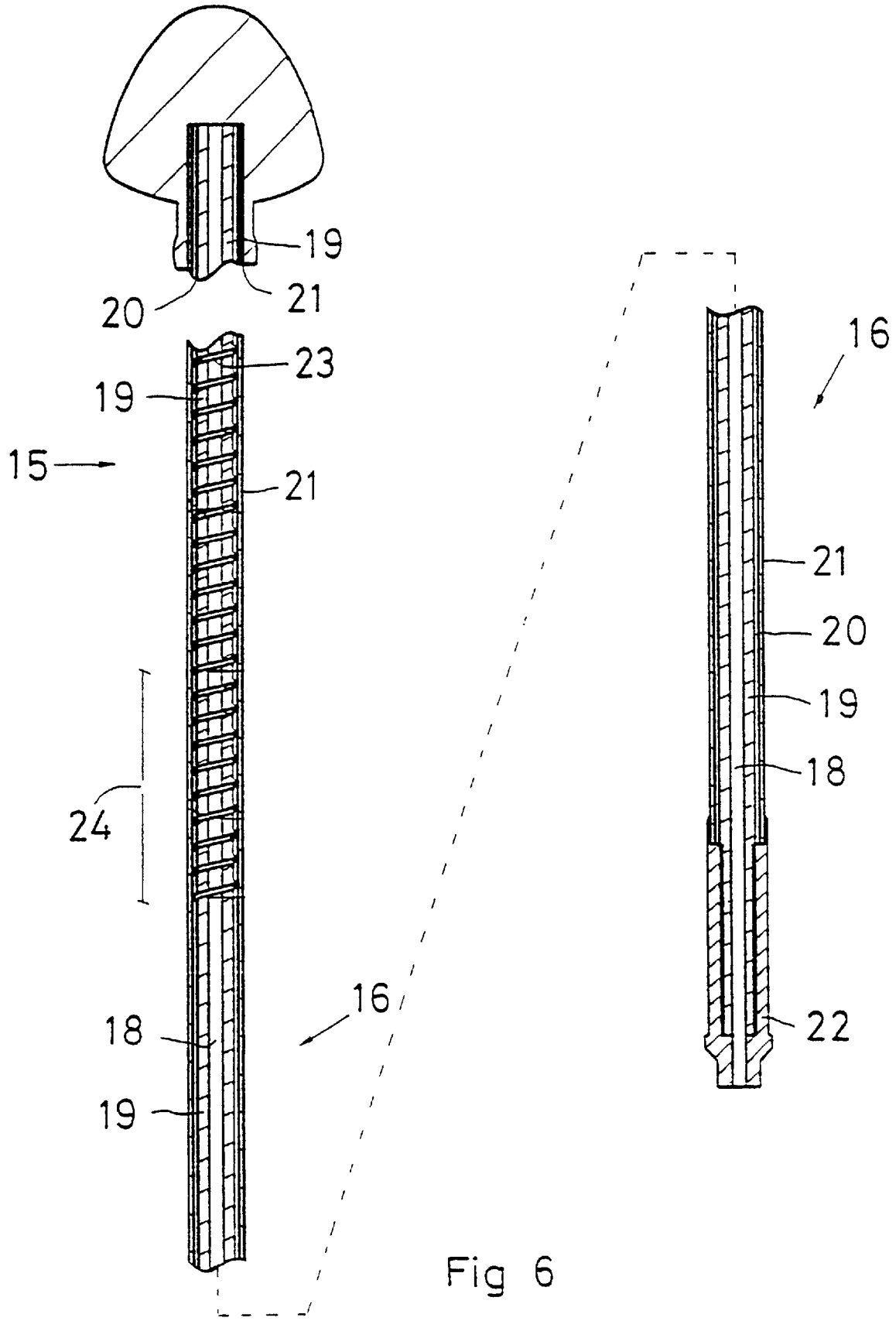
FIG. 6 is a cross section through an antenna rod included in the antenna device according to FIGS. 1 and 2.

As is apparent from FIG. 6, the fourth antenna element 16, i.e. the antenna element of the rod arrangement 3 for the high frequency band, has an elongate, metallic connector 18 which serves the function of a rod antenna which is set to the higher frequency band. Around the rod antenna 18, the rod arrangement has an insulating tube 19, and outside this a spacer 20 designed as an insulating tube which is surrounded by a surface coating 21 of insulating material. In its lower end, the straight rod antenna 18 is galvanically connected to a metal sleeve 22 via which the rod arrangement 3 is supplied.

The third antenna element 15, which is designed for use in the low frequency band in the talk position of the antenna device, is designed as a helix antenna 23 which is disposed on the outside of the insulating tube 19 of the rod arrangement. Within the longitudinal extent of the helix 23, the spacer 20 is absent, since the helix 23 takes up its place. Possibly however, parts of the spacer 20 may be disposed between the winding turns in the helix 23. The helix 23 is set for use in the lower frequency band and is, in terms of supply, capacitatively coupled to the metallic conductor 18 which, on operation in the lower frequency band, functions as an extension of the supply lead to the rod arrangement 3. The capacitative coupling is realised in that the helix 23 in the longitudinal direction overlaps the metal conductor 18 within a region which is marked by reference numeral 24 in FIG. 6. It will be apparent that the helix 23 terminates with its lower end at the lower end of the region 24 and that the metallic conductor 18 terminates with its upper end at the upper end of the region 24. Within the overlap zone, there is naturally the insulating tube 19 between the helix 23 and the conductor 18.

While not being apparent from FIG. 6, the rod arrangement 3 has, over the helix 23, the upper portion 17 which is electrically insulating. Within this region, the rod arrangement includes the insulating tube 19, the spacer 20 and the surface coating 21.

On operation of the rod arrangement 3, this functions as follows.

On operation of the rod arrangement 3, this is galvanically connected to the circuits of the mobile telephone in that the metal sleeve 22 at the lower end of the rod arrangement is galvanically connected to these circuits in a manner which will be described in greater detail hereinbelow.

In operation in the higher frequency band, the conductor 18 functions as a quarter wave rod antenna, while the helix 23 constitutes a capacitatively coupled top load to the rod antenna. The presence of this top load implies that the rod antenna may be made physically shorter than its electric length.

In operation in the lower frequency band, the metallic conductor 18 functions only as a coupling lead between the connection of the antenna device to the circuits of the mobile telephone and the capacitative coupling zone 24 between the conductor 18 and the helix 23.

FIG. 3 shows a section through the upper portion of the antenna device in the stand-by position. It will be apparent from the figure that the antenna device is built-up around a bushing portion 5 produced from metal, which is intended for securing the antenna device in a casing (not shown) for the mobile telephone and which is galvanically connected to the circuits of the mobile telephone. The bushing portion 5 has a central, through-going channel for accommodating the rod arrangement 3, and further an upper, substantially cylindrical portion 6, which serves as an anchorage for the helix arrangement 4. Further, the bushing portion has a lower portion 8 with a thread 9 which serves for securing the antenna device on the mobile telephone.

Interiorly in the bushing portion, there are provided a number of resilient contact tongues 25. In the retracted position of the rod arrangement, FIGS. 2 and 3, these rest on the insulating outer layer of the rod arrangement, for which reason the rod arrangement is electrically disconnected from the bushing portion 5 and thereby also from the circuits of the mobile telephone. In the protracted position of the rod arrangement, FIG. 1, the contact tongues 25 rest on the metal sleeve of the rod arrangement, for which reason the rod arrangement is galvanically coupled to the circuits of the mobile telephone.

A summary description of the helix arrangement 4 will be given below.

The helix arrangement is built-up around a carrier portion 7 producted from insulating, non-magnetic material and secured on the cylindrical portion 6.

The carrier portion 7 has a central, substantially cylindrical channel 10 which is open in the upper end of the carrier portion. Interiorly in the channel 10 of the carrier portion 7, there is provided a first antenna element 11 which is designed as a helix. The first antenna element 11 is set for the lower frequency band for the antenna device and is galvanically connected to the electric circuits of the mobile telephone.

On the outside of the carrier portion, there is disposed a second antenna element 12, also designed as a helix, and designed for the higher frequency band. The second antenna element 12, i.e. the helix, is galvanically discrete from the electric circuits of the mobile telephone and is supplied inductively/capacitatively from the first antenna element 11.

A hood 13 of electrically insulating, non-magnetic material is disposed around the second antenna element 12 and the carrier portion 7. The hood 13 has, in its upper end (facing away from the bushing portion 5), an opening 14 for permitting the passage and longitudinal displacement of the rod arrangement 3.

Electrically, the helix arrangement 4 functions as follows. The first antenna element 11, i.e. the helix disposed interiorly in the carrier portion 7, is galvanically connected to the circuits of the mobile telephone. When the antenna element 11 is supplied with or receives electromagnetic radiation within the lower frequency band, this radiation will pass through the second antenna element 12 without being influenced to any appreciable degree thereby, since it has a resonance frequency a safe distance from the resonance frequency of the first antenna element 11 and further, because it is so "scant" that it has no appreciable screening-off effect. The second antenna element, i.e. the outer helix, is set to the higher frequency band, for which reason it must have a considerably fewer number of turns and greater pitch than is the case with the first antenna element. For this reason, the second antenna element 12, seen from the first antenna element 11, will, as intimated above, be considered as transparent. If transmission takes place within the higher frequency band, the second antenna element 12, i.e. the outer helix, will function as radiating element which is capacitatively/inductively coupled to the inner helix 11. Correspondingly, on receiving within the higher frequency band, a capacitative/inductive coupling will be in place between the two antenna elements 12 and 11 so that received energy is transmitted between them.

In the foregoing, the rod arrangement 3 has been described in detail and the helix arrangement 4 has been described schematically, individually both electrically and mechanically. With reference to FIG. 3, it will now be disclosed how cooperation between them takes place.

The bushing portion 5 has, as was mentioned above, a through-going channel through which the rod arrangement 3 is displaceable in the longitudinal direction. In order to prevent play and give the desired electric contact, there are disposed interiorly in the bushing portion 5, metallic spring elements which slide along the surface coating 21 of the rod arrangement 3 when the rod arrangement is displaced. In the protracted position of the rod arrangement, in the talk position as shown in FIG. 1, the bushing portion 5 with its spring elements 25 realises electric contact with the lower contact sleeve 22 of the rod arrangement, whereby the rod arrangement will be directly galvanically couple to the circuits of the mobile telephone.

In the position of the rod arrangement according to FIG. 2, i.e. the stand-by position, the lower end of the inner helix 11 rests on an electrically conductive washer 26 which in turn rests on the upper side of the cylindrical upper portion 6 of the bushing portion 5. Hereby, an electrical galvanic connection prevails between bushing portion and the lower end of the inner helix 11.

Figure 7:
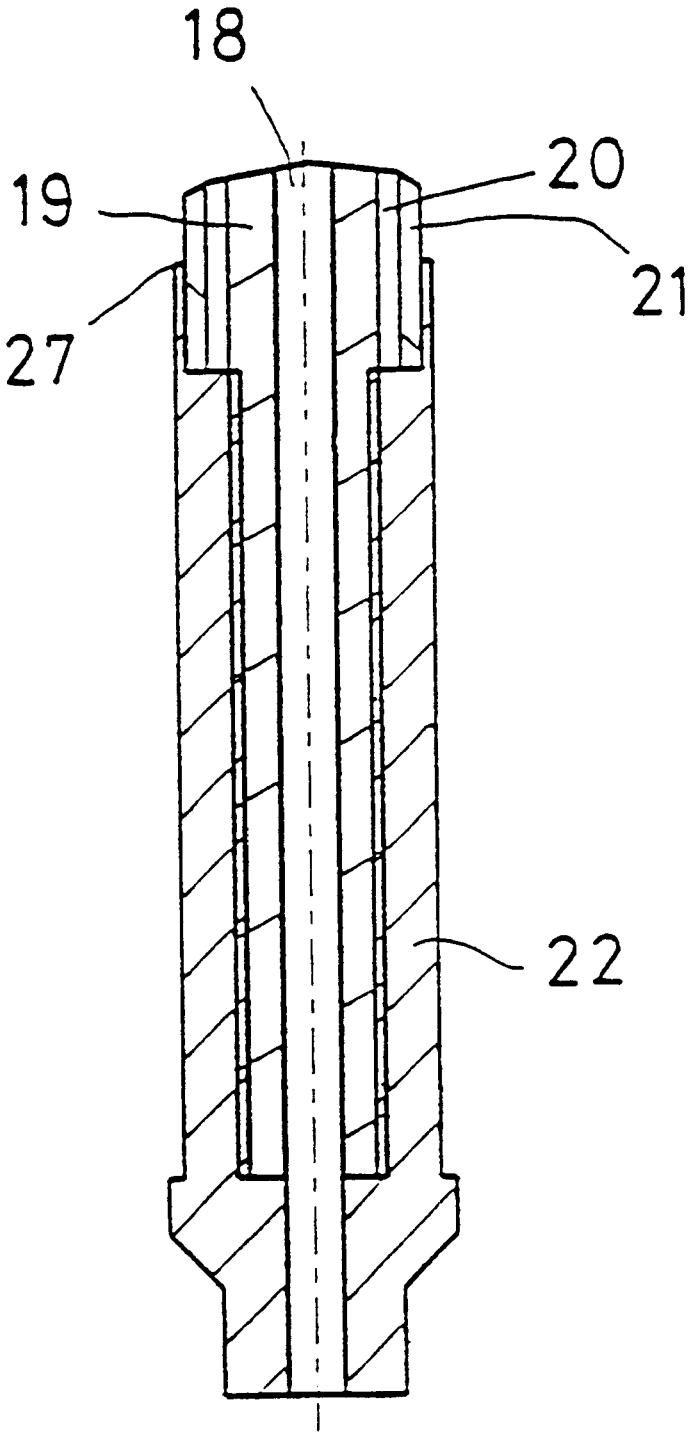
FIG. 7 shows, on a larger scale, a lower end portion of the antenna rod according to FIG. 6.

On protraction of the rod arrangement from the position illustrated in FIG. 2 to the position illustrated in FIG. 1, the rod arrangement will slide through the helix arrangement 4 until such time as its projecting edge region 27 (FIGS. 4 and 7) on the upper end of the metal sleeve 22 comes into abutment against the underside of the washer 26. On continued lifting, the washer 26 will accompany the rod arrangement 3 in its upwardly directed movement, whereby the inner helix 11 is compressed in the axial direction. Granted, the helix 11 is still galvanically coupled to the electric circuits of the mobile telephone but will, as a result of this axial compression, first have a misadptation as regards frequency and thereafter wholly cease to exist as a radiating antenna element. Hereby, the outer helix 12 is naturally also electrically disconnected.

In one alternative embodiment, it is possible, on the upper side of the metallic sleeve 22 on the lower end of the rod arrangement 3, to place a ring 28 of insulating material. On protraction of the rod arrangement 3, the ring 28 will come into abutment against the washer 26 and lift this out of electric contact with the bushing portion 5. As a result, the inner helix 11 will be electrically disconnected from the circuits of the mobile telephone as soon as the washer 26 has been lifted out of electric contact with the bushing portion 5.

In the rod arrangement, the helix 23 has a length of approx. 40 mm, containing 40–42 turns and with a pitch of 0.8 mm. The overlap length 24 amounts to approx. 9 mm. The total length of the entire rod arrangement is approx. 116 mm.

The present invention may be modified without departing from the scope of the appended claims.

What is claimed is:

1. A dual band antenna for a radio communication apparatus, said dual band antenna having a first and a second antenna element operating in one higher and one lower frequency band, respectively;

the first and second antenna elements being disposed in line with one another;

the first antenna element being galvanically connected to the circuits of the apparatus;

the second antenna element being capacitively coupled to the first antenna element and connected to the circuits of the apparatus via the first antenna element; and both the first and second antenna elements being received in a common insulating sleeve thereby giving the antenna the outer configuration of a unitary elongated rod.

2. The dual band antenna of claim 1 wherein said first antenna element is a straight metallic conductor.

3. The dual band antenna of claim 2 wherein said second antenna element is a helix extending about a portion of said straight metallic conductor.

4. The dual band antenna of claim 3 further comprising a first insulating layer which extends about said straight metallic conductor and internally within said helix.

5. The dual band antenna of claim 4 further comprising; a second insulating layer external to said first insulating layer and extending over said first insulating layer and said straight metallic conductor, with said helix being embedded in or free of said second insulating material.

6. The dual and antenna of claim 5 further comprising a third insulating layer defining an outermost surface of said elongated unitary rod.

7. The dual band antenna of claim 1 wherein each of said first and second antenna elements are covered by a common insulating layer which defines an outermost surface of said elongated unitary rod.

8. The dual band antenna of claim 1 wherein said elongated unitary rod comprises an insulated top portion free of said first and second antenna elements, an intermediate portion of overlap of said first and second antenna elements, and a lower portion including said first antenna element but free of said second antenna element.

9. The dual band antenna of claim 8 wherein said first antenna element is a metallic conducting bar and said second antenna element is a helix wire surrounding said metallic conducting bar, with said first and second antenna elements being covered by insulating material and fixed in position relative to each other.

10. The dual band antenna of claim 9 wherein said elongated unitary rod includes a metallic sleeve covering a lower end portion of said rod and said dual band antenna further comprising an insulating ring at an upper end of said metallic sleeve.

11. A dual band antenna for a radio communication apparatus, comprising:

a top portion made from a non-conductive, non-magnetic material;

a first and a second antenna element operating in a higher and a lower frequency band, respectively; and the top portion and the first and second antenna elements being disposed in line with one another with the top portion and the first antenna element at opposite ends of the antenna thereby giving the antenna the outer configuration of a unitary, elongated rod.

12. The antenna device as claimed in claim 11, wherein said first antenna element for the higher frequency band is an elongated metallic conducting rod or bar antenna.

13. The antenna device as claimed in any of claims 12 wherein the second element for the lower frequency is a helix.

14. The antenna device as claimed in claim 13 wherein said helix has an end portion which surrounds an end portion of the elongated metallic conducting rod or bar antenna with an electrically insulating layer being disposed therebetween.

15. The antenna device as claimed in any of claim 11 wherein the second antenna element for the lower frequency band is disposed to constitute a capacitatively coupled top load to the first antenna element for the higher frequency band on operation of the antenna device in the higher frequency band.

16. The antenna device as claimed in claims 11 characterized in the antenna element for the higher frequency band is disposed to constitute a part of a supply lead to the second antenna element for the lower frequency band on operation of the antenna device in the lower frequency band.

17. A dual band antenna for a radio communication apparatus comprising;

one first and one second antenna element operating in a higher and a lower frequency band, respectively;

the second antenna element being a helix;

the first and second antenna elements being disposed in line with one another thereby to have the outer configuration of an elongated, unitary rod; and said rod having one single connection to the circuits of the apparatus, this connection being galvanic.

18. The antenna device as claimed in claim 17 wherein said first antenna element for the higher frequency band is a metallic conducting rod or bar antenna.

19. The antenna device as claimed in claim 17 wherein said helix has an end portion which surrounds an end portion of the rod or bar antenna with an insulating layer being disposed therebetween.

20. The antenna device as claimed in claim 17 wherein the second antenna element for the lower frequency band is disposed to constitute a capacitively coupled top load to the first antenna element for the higher frequency band on operation of the antenna device in the higher frequency band.

21. The antenna device as claimed in claim 17 characterized in that the first antenna element for the higher frequency band is disposed to constitute a part of a supply lead to the second antenna element for the lower frequency band on operation of the antenna device in the lower frequency band.

22. A dual band antennal for a radio communication apparatus with the dual and antenna having an outer configuration of an elongated unitary rod, and said dual band antenna comprising;

one first and one second antenna element operating in one higher and one lower frequency band, respectively;

the first antenna being a straight metallic conductor;

the second antenna element being a helix;

the conductor and the helix having lengthwise overlapping portions in that an end portion of the conductor is received internally in a corresponding end portion of the helix.

23. The antenna device as claimed in claim 22 wherein the second antenna element for the lower frequency band is disposed to constitute a capacitively coupled top load to the first antenna element for the higher frequency band on operation of the antenna device in the higher frequency band.

24. The antenna device as claimed in claim 22 characterized in that the first antenna element for the higher frequency band is disposed to constitute a part of a supply lead to the second antenna element for the lower frequency band on operation of the antenna device in the lower frequency band.

* * * * *